US005215304A

United States Patent [19]

Pinel, Jr. et al.

[11] Patent Number: 5,215,304

[45] Date of Patent: * Jun. 1, 1993

[54] BOWLING BALL

[75] Inventors: Maurice L. Pinel, Jr., Hampton; Richard W. Sadles, Newport News, both of Va.

[73] Assignee: Morich Enterprises Incorporated, Newport News, Va.

[ * ] Notice: The portion of the term of this patent subsequent to Aug. 6, 2008 has been disclaimed.

[21] Appl. No.: 690,510

[22] Filed: Apr. 24, 1991

[51] Int. Cl.[5] ..... A63B 37/10

[52] U.S. Cl. ..... 273/63 E

[58] Field of Search ..... 273/63 E, 63 R, 63 A, 273/63 B, 63 C, 63 D, 63 F, 63 G

[56] References Cited

U.S. PATENT DOCUMENTS

| | | | |
|---|---|---|---|
| 746,576 | 12/1903 | Rice | 273/63 E |
| 1,026,069 | 5/1912 | Bendelari | 273/63 E |
| 3,181,864 | 5/1965 | Rolke | 273/63 E |
| 3,400,929 | 9/1968 | Fabanich | 273/63 E |
| 3,441,274 | 4/1969 | Collins | 273/63 E |
| 3,591,177 | 7/1971 | Skuse | 273/63 E |
| 3,810,619 | 5/1974 | Taylor | 273/63 E |
| 4,058,310 | 11/1977 | Miettinen | 273/63 E |
| 4,099,715 | 7/1978 | Caplan | 273/63 E |
| 4,131,277 | 12/1978 | Randolph | 273/63 E |
| 4,183,527 | 1/1980 | Amburgey | 273/63 E |
| 4,592,551 | 6/1986 | Lee | 273/63 E |
| 4,802,671 | 2/1989 | Gentiluomo | 273/63 E |
| 4,913,429 | 4/1990 | Fabanich | 273/63 E |
| 5,037,096 | 8/1991 | Pinel, Jr. et al. | 273/63 E |
| 5,058,901 | 10/1991 | Salvino | 273/63 E |
| 5,074,553 | 12/1991 | Pawlowski et al. | 273/63 E |
| 5,149,089 | 9/1992 | Żelinski | 273/63 E |

*Primary Examiner*—George J. Marlo

*Attorney, Agent, or Firm*—Schweitzer Cornman & Gross

[57] ABSTRACT

A two-piece bowling ball includes a weight block or core to provide improved and increased rotational inertia positioned within an surrounded by a shell of a different density. The block consists of head, body and tip portions, the head being in the form of a spherical segment of one base having its spherical surface concentric with the surface of the ball and spaced no more than about 1.5 inches from the ball surface. The body is in the form of a cylinder or parallelepiped, while the tip is of a shape having a maximum diameter no greater than that of the body whose diameter is no greater than that of the head. The block is mounted within the ball such that its longitudinal axis is generally aligned with the geometric center of the ball. The tip is chosen such that overall top eccentricity does not exceed three ounces in accordance with ABC guidelines.

14 Claims, 7 Drawing Sheets

BOWLING BALL

The present invention relates to an improved bowling ball weight block which provides more consistent performance over a range of lane conditions.

BACKGROUND OF THE INVENTION

Lane conditions encountered by a bowler vary significantly. In addition to large variations among different lanes due to age, condition and type of surface, the same lane can vary in surface condition over the course of a game or tournament as a result of its usage. The condition and surface of a lane affects the dynamics of ball travel down the lane and accordingly can cause variation in the path of the ball despite efforts of the bowler to maintain a consistent roll.

Experienced bowlers can control the trajectory of the ball and accordingly are able to adjust to some degree for different lane conditions. Even with such adjustments, however, variations in the condition and surface of the lane across the width and along the length of the lane still can place inconsistencies and variations in ball travel which are unpredictable and detrimental to the player. Accordingly, it is desirable and advantageous to provide a ball which, to the greatest extent possible, provides a consistent roll, minimizes roll variations due to lane surface conditions, thus maximizing the control of the bowler over the ball and providing predictable, consistent characteristics for ball travel.

The present invention provides a weight block which forms the core of a two-piece bowling ball construction which has the effect of providing increased consistency of ball roll over a wide range of lane conditions.

The present invention utilizes an internal weight block to provide a substantially increased rotational inertia while conforming with guidelines established for bowling balls by the American Bowling Congress and Women's International Bowling Congress. In particular, a bowling ball utilizing the present invention provides increased angular momentum to minimize the roll effects of the lane surface while maintaining a weight eccentricity of less than three ounces after drilling when tested according to ABC/WIBC guidelines and maintaining a total ball weight of no more than sixteen pounds. Accordingly, a ball utilizing the present invention can be fully sanctioned for use at all levels and in all competitions.

BRIEF DESCRIPTION OF THE INVENTION

The present invention comprises a weight block which, for descriptive purposes herein, is defined as comprising adjacent head, body and tip portions. The weight block is characterized by the head being in the form of a generally spherical segment whose surface is approximately concentric with the outside surface of the ball and is positioned one inch or less from the surface of the ball.

The body of the weight block is cylindrical or of a regular parallelepiped configuration, of a radius no greater than the radius of the head, and has a length no greater than the diameter of the head, terminating at a point located between the horizontal mid-line of the block and the point corresponding to the head diameter. The body may optionally include an annular ring projecting outwardly over a portion of its surface.

The tip terminates the weight block at its lower end and is in a form of an element chosen such that the total weight of the block lying below the horizontal axis of the ball is less than the portion of the block above the mid-line. The maximum radius of the tip is no greater than that of the body. The overall top weight eccentricity of the ball after drilling is not to exceed 3 ounces as measured in accordance with ABC guidelines.

BRIEF DESCRIPTION OF THE DRAWINGS

A fuller understanding of the present invention will be achieved upon consideration of the following detailed description of preferred, but nonetheless illustrative embodiments of the present invention when taken in association with the annexed drawings, wherein.

DETAILED DESCRIPTION OF THE INVENTION

Figure 1:
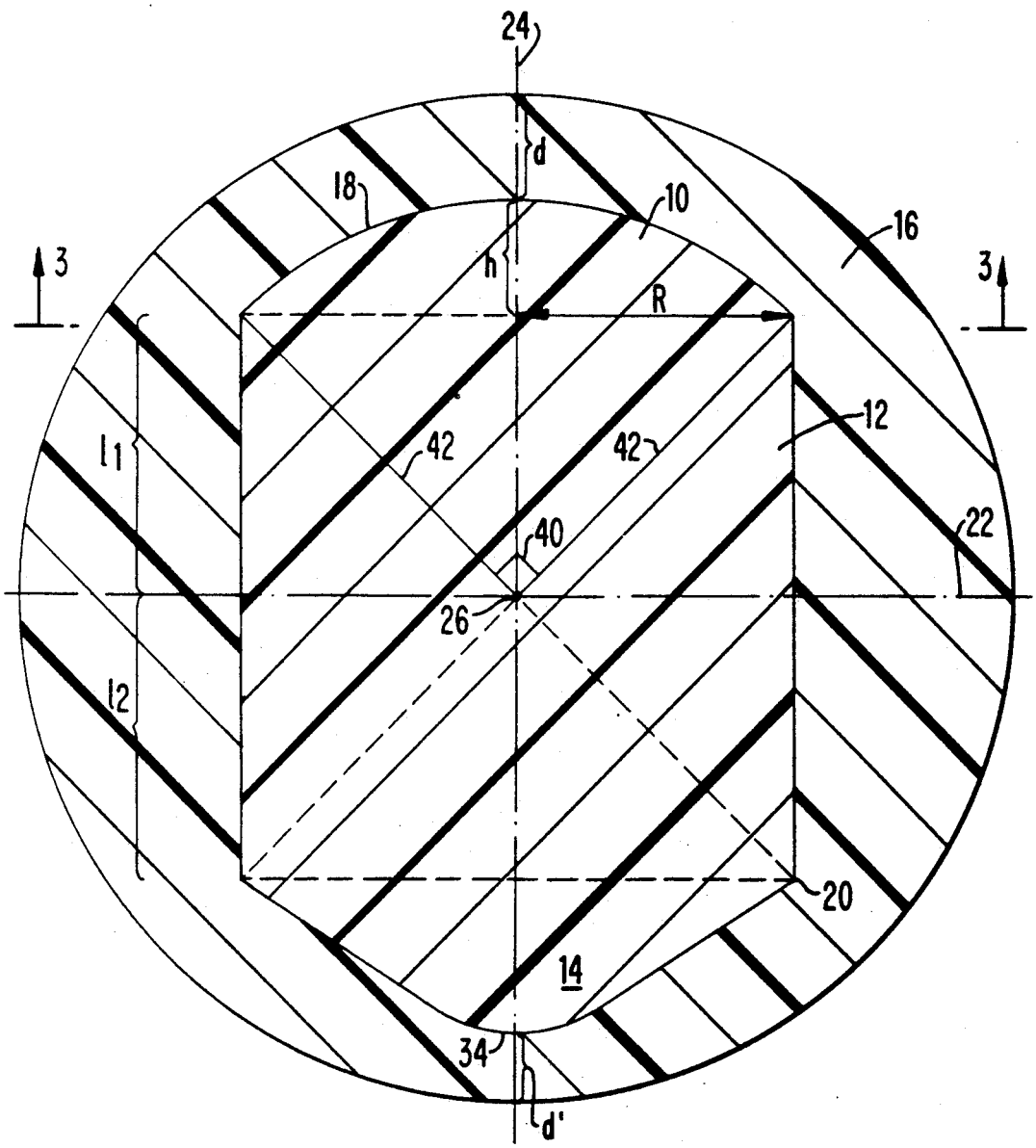
FIG. 1 is an elevational cross-sectional view of a first embodiment of a weight block of the present invention shown in position within a bowling ball.

As seen initially in FIG. 1, the weight block of the present invention has a head portion 10, a body portion 12, and a tip portion 14, typically formed out of a unitary mass of an appropriate compound, typically a polyester or urethane, compounded as known in the art to an appropriate density to allow the combination of the weight block and the shell 16 of the ball to fall within the 16-pound limit. Typically the weight block is of a greater density than the shell. The weight block is symmetric about its centerline 24.

As shown, the head portion 10 is defined as a spherical segment whose top surface 18 is generally concentric with the outer surface of the ball. As a regulation bowling ball is of 8.59 inch diameter, the radius of curvature 42 for top surface 18 is in the order of 3.07 to 3.80 inches, corresponding to a spacing distance between the ball surface and head of between about 1.225 and .495 inches. In general, this distance "d" is typically not less than one-half inch to provide sufficient thickness of the shell to protect the core and to maintain proper rolling characteristics. With certain formulations for the shell, it is expected that this distance can be lessened. The radius of the base of the head R is generally defined by the distance between perpendicular radii 42, the 90° angle 40 therebetween being bisected by the centerline of the core block, subject to about plus or minus ½ inch deviation. The core is positioned within the ball such that its vertical centerline axis 24 either aligns with the vertical centerline of the ball as defined by the positioning of an alignment pin as known in the art, or offset to a maximum of about 30 degrees. The ball centerline typically passes through the location of the ball label at its upper end, which defines the "top" of the ball, and further represents the area in which the finger holes are drilled.

Extending downwardly towards the geometric center of the ball 26 is body portion 12, preferably in the form of a cylinder having its axis along the core vertical axis 24. As depicted in FIG. 1, the cylinder has the radius R of the spherical head segment 10, but may be of a lesser radius as will be illustrated and explained hereinafter. The length of the body is chosen to be no greater than the diameter of the head (2R), extending to a point (such as 20) below the horizonal centerline axis 22 of the ball. With a radius of curvature 42 between 3.07 and 3.80 inches, the radius R of the head is between 4.34 and 5.37 inches, subject to the ½ inch deviation. The horizontal centerline of the ball typically is aligned with the ball centerline, but may be displaced slightly depending on the positioning of the block within the core.

As shown FIG. 1, the body is without surface protrusions. The invention, however, encompasses body configurations including annular rings of varying dimensions as shall be illustrated herein.

Figure 3:
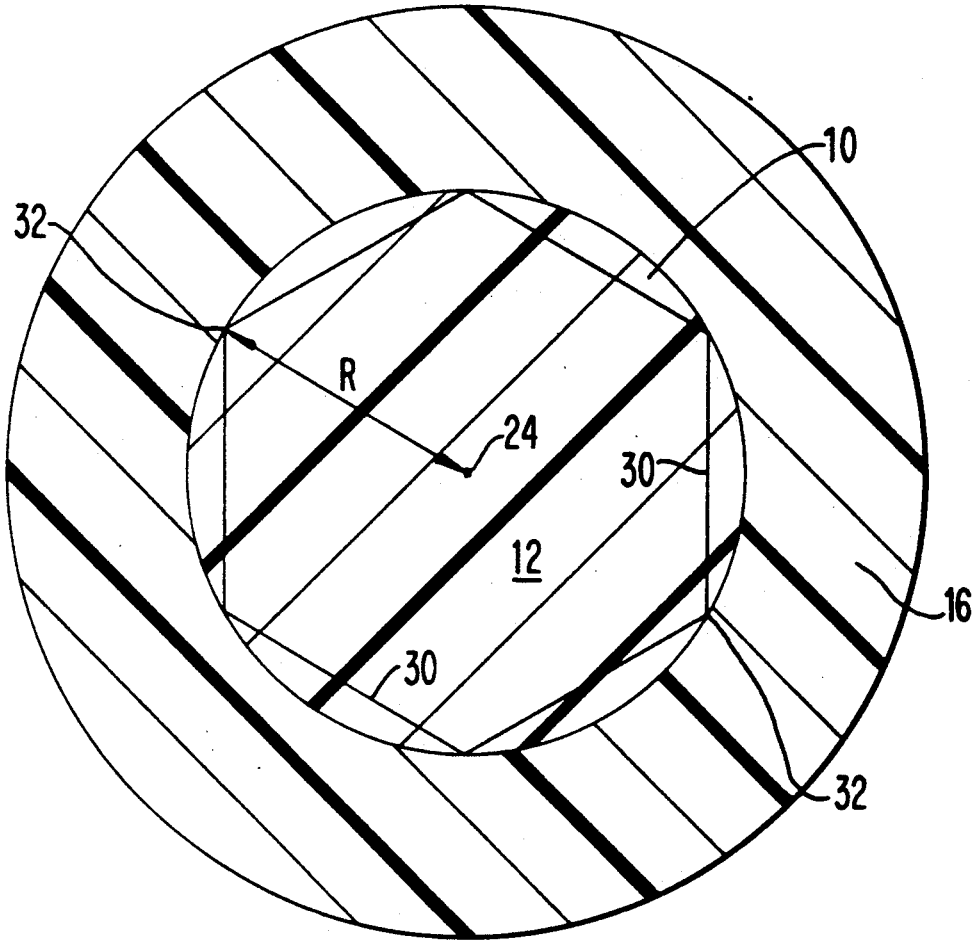
FIG. 3 is a sectional plan view looking upward from line 3—3 in FIG. 1, taken along a line parallel to and just below the intersection the body and head portion, depicting an alternative shape for the body.

In addition to a cylindrical body, the present invention contemplates that the body may be in the form of a regular parallepiped, subject to the same dimensional restraints as the cylindrical body type. As shown in FIG. 3, the radius R of the head is to the maximum distance or radius from the block vertical centerline 24 to the surface of the body, here shown as a regular hexagon with sides 30, which corresponds to the distance R to the vertices 32 of the sides. A preferred arrangement for such parallelepiped body form is with 6 or more sides.

Referring again to FIG. 1, the block terminates at its lower end in tip portion 14 which is shown as being of a tapered configuration. The tip portion is chosen such that the volume and accordingly the weight of the portion of the weight block below the centerline 22 of the ball is less than the weight of the upper portion. For weight blocks of constant density, the weights of the portions are directly proportional to their volumes. For the embodiment of FIG. 1 the weight of the upper portion, above centerline 22, corresponds to the sum of the weights of the head and the portion of the body above the centerline 22. The volume of the head is represented by the formula $V_{head}=1/6\pi h\ (3R^2+h^2)$, while the volume of the upper portion of the body is represented by the formula $V_{b1}=\pi R^2 l_1$. Similarly, the volume of the lower portion of the body is represented by $V_{b2}=\pi R^2\ l_2$. Using these formulas, an appropriate weight value for the tip can be determined and dimensions assigned, with regard to the total weight of the ball and weight offset after drilling requirements.

Figure 2:
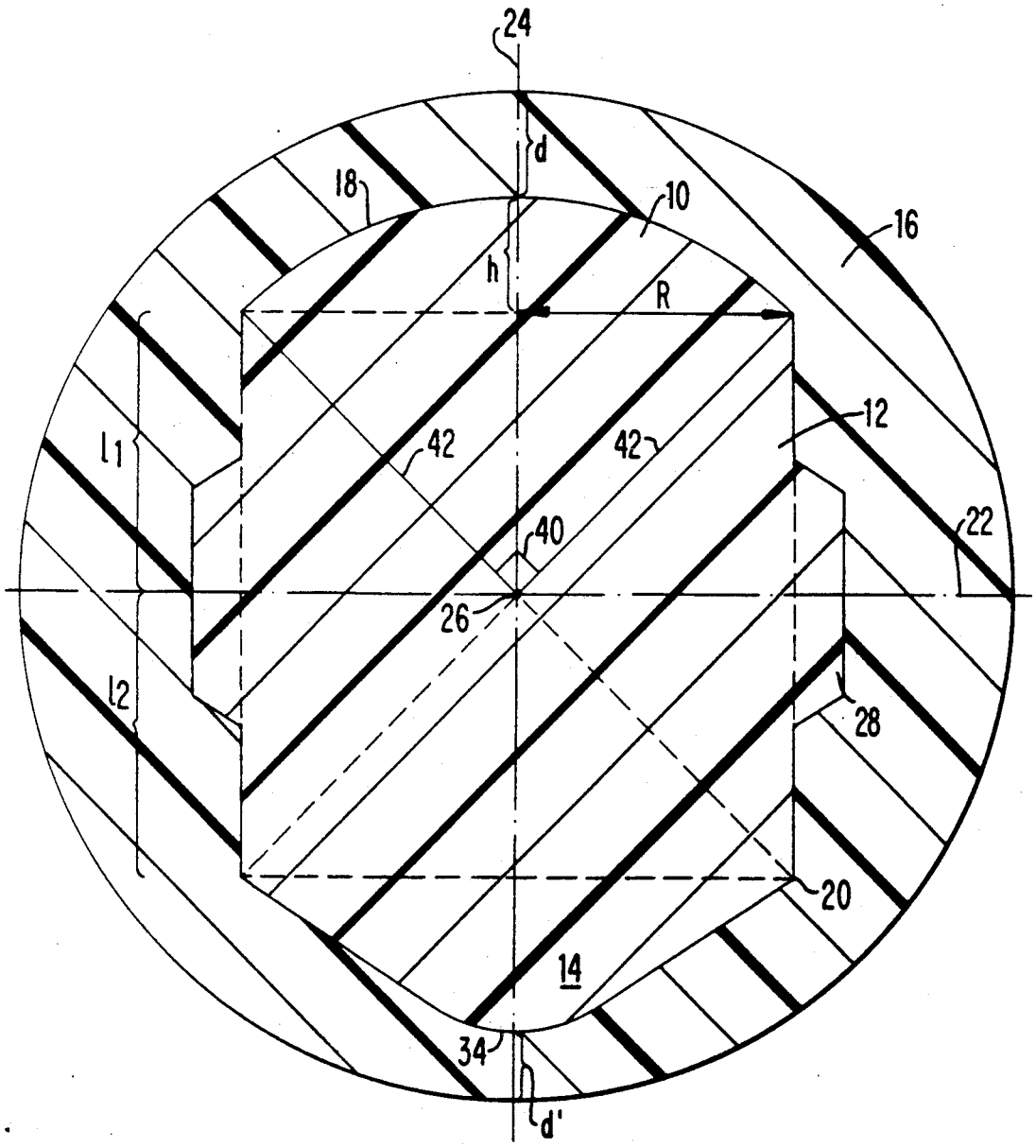
FIG. 2 is an elevational cross-sectional view of the embodiment of FIG. 1 incorporating an annular ring about the body.
Figure 4A:
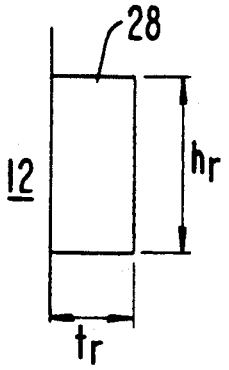
FIGS. 4A and 4B are illustrative alternate forms for the annular ring, in cross-section.
Figure 4B:
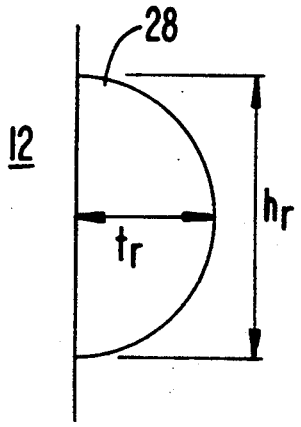

As shown in FIG. 2, the body 12 may further include a cylindrical ring portion 28 encircling the body. As used herein, the term "ring" refers to an encircling protrusion upon the surface of the body portion, whether defined by planar or curved surface elements, so long as the ring is symmetrical about its circumference. Thus, the ring may be trapezoidal in cross-section as shown in FIG. 2, rectangular as depicted in FIG. 4*a*, generally spherical as depicted in FIG. 4*b*, or a combination of such or other alternative configurations. Both the height $h_r$ and thickness $t_r$ of the ring are variable. The ring may extend along either the full length or a portion of the body. The thickness $t_r$ of the ring, however, is not to exceed approximately 1 ½ inch at its thickest point. The size and positioning of the ring must be considered in performing the upper and lower weight calculations. In preferred embodiments, the height centerline of the ring is located on or above the horizontal centerline cf the weight block.

The tip portion may be of varied configuration so long as its maximum radius does not exceed the radius of the body. The distal end of the tip may include a pointed, flat, or curved termination. The profile of the tip may be either smooth or stepped, and may be cylindrical or include a reverse taper or widening towards its distal end, so long as it maintains radial symmetry about the vertical center line 24 of the block. Within such guidelines, the tip may bear planar faces as well as a smooth curve about its circumference. It is preferred, however, that the tip surface be curved, and terminate in a spherical cap 34 whose surface is concentric with the ball surface, with a spacing d' from the ball surface of no more than approximately 1.5 inches nor less than 0.5 inches.

Figure 5:
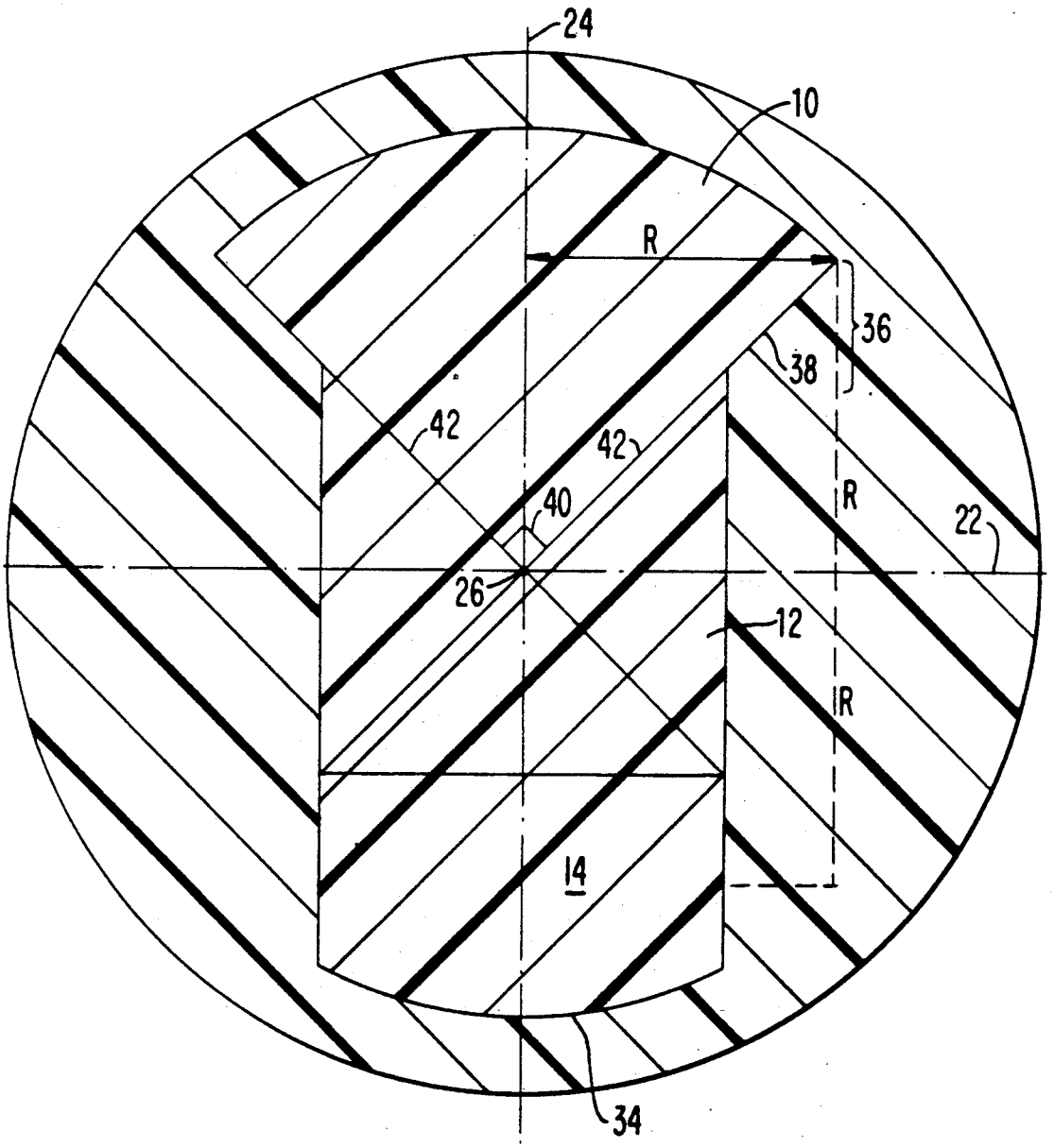
FIG. 5 is a cross-sectional view of an embodiment having a steppted tip.

As shown in FIG. 5, the body portion 12 of the weight block may be of a radius less than the radius R of the head. In such a case, there must be transition region 36 between the radius R of the head and the radius of the body. The transition region can be defined by an angular surface 38. If the head is defined as a spherical segment between the rotated included right angle 40 bisected by centerline 24 , the surface 38 may preferably lie along the rays 42 of the right angle. Plane geometry teaches that the rays 42, when extended downwardly beyond the vertex of the right angle 40, define the diagonals of a square of sides 2R. Thus, the extension of the rays define the maximum extent for the length of body portion 12. As shown in FIG. 5, this total maximum length includes any transition area 38. The tip portion 14 has an upper portion of a radius equal to that of the body, terminating in generally spherical cap 34.

Figure 6:
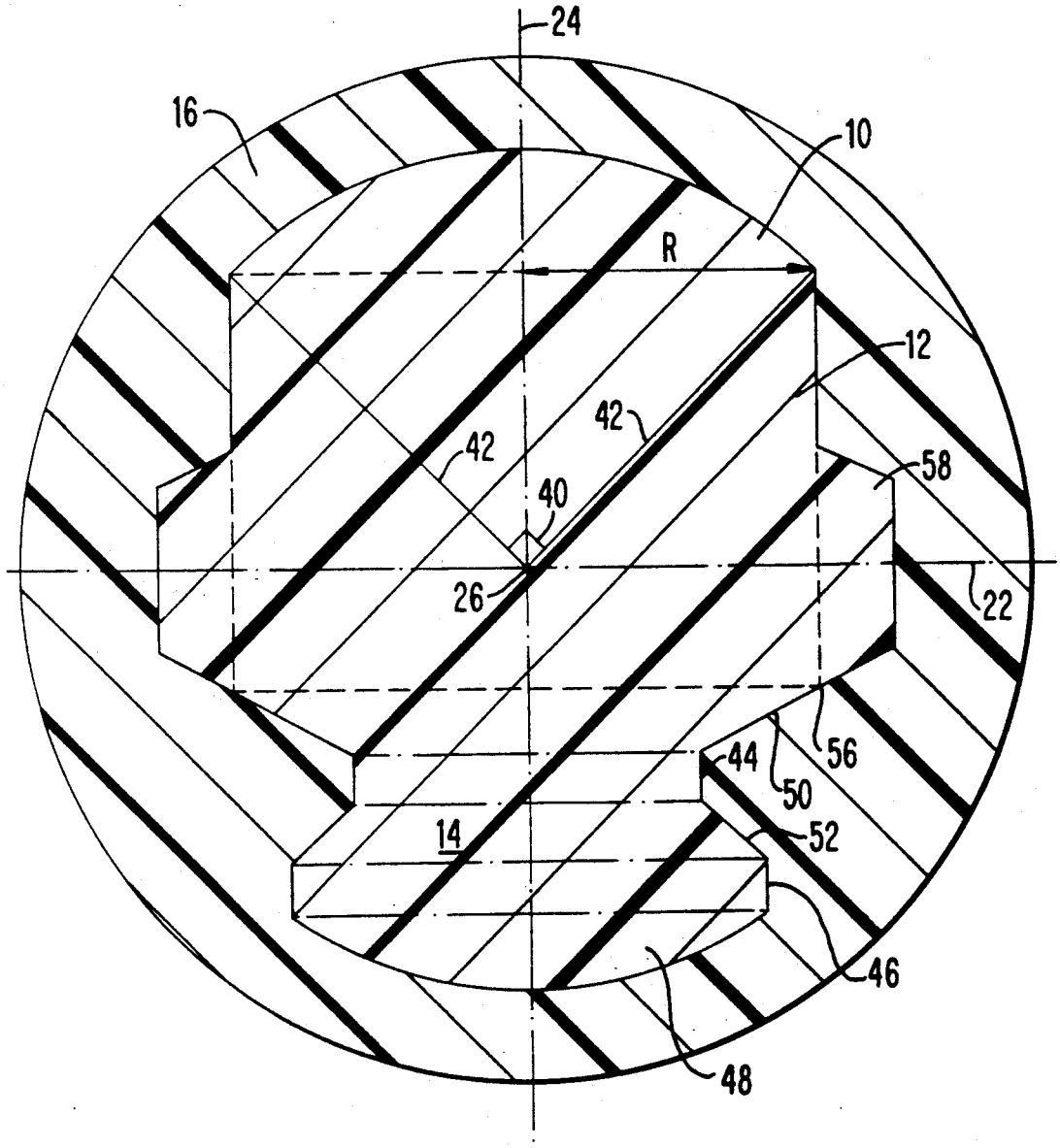
FIGS. 6–8 represent other alternative embodiments in cross-section.

FIG. 6 depicts another alternative embodiment which utilizes a tip portion 14 of varying diameter. As shown therein, the body 12 includes a trapezoidal ring 58, the lower end of which terminates the body portion at 56. The tip 14 includes a central cylindrical portion 44 capped by a second cylindrical portion 46 of greater diameter bearing spherical bottom 48. To facilitate manufacture and avoid sharp corners which might induce stress cracking, transition elements 50 and 52 are utilized between cylindrical portion 44 and the body 12 and second cylindrical portion 46, respectively. The maximum radius of the tip, at the line 56 of intersection with the body, does not exceed the radius of the body 12.

Figure 7:
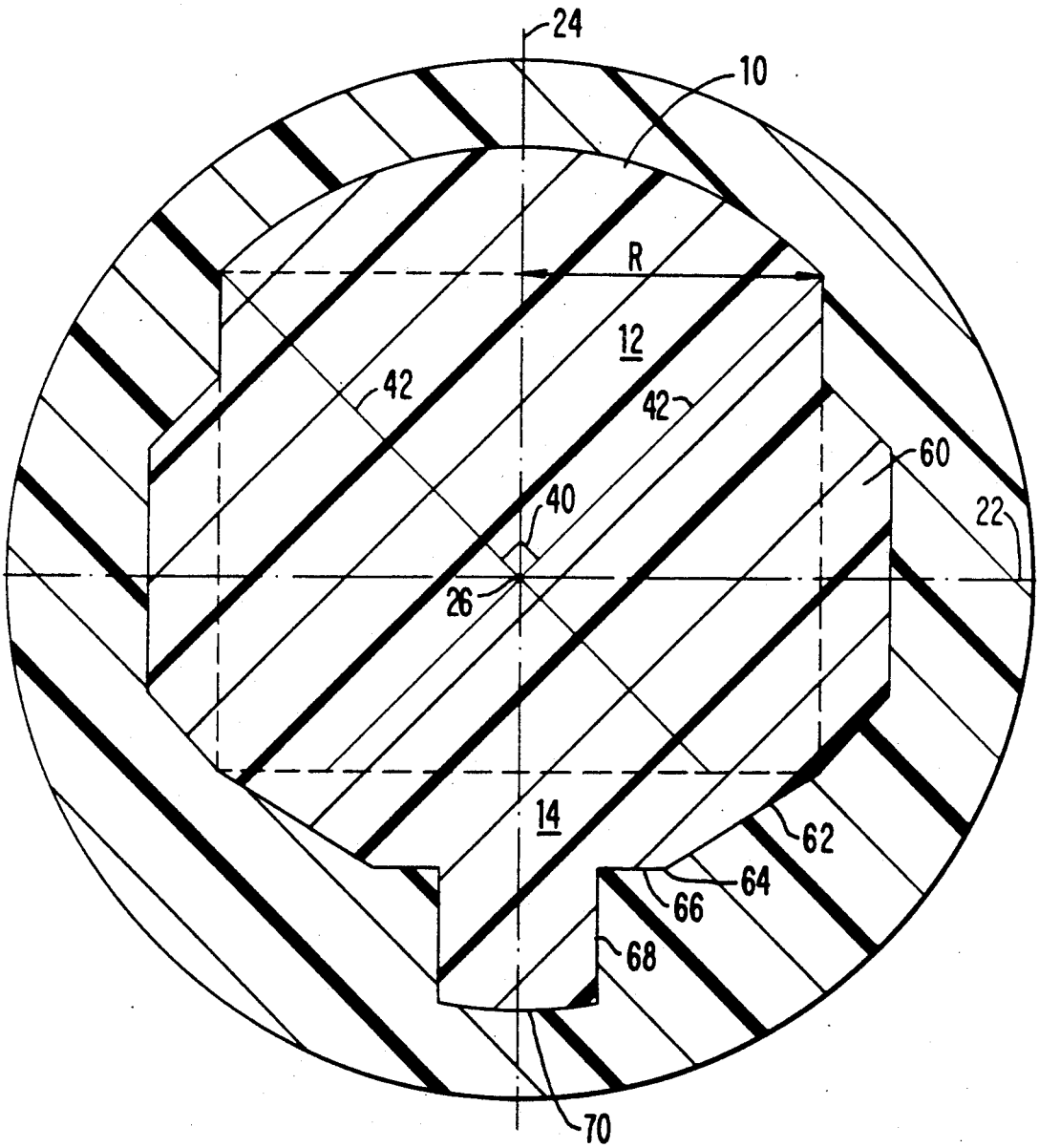

FIG. 7 depicts an embodiment where body 12 bears a trapezoidal ring 60, and where tip 14 is of a stepped, generally tapered form. First portion 62 tapers from the radius of the body to a smaller radius at 64, which defines the outer edge of horizontal shoulder 66. The tip ends in cylindrical portion 68, having a slightly curved cap 70. Again, the geometry of the tip falls within the guidelines set forth above.

Figure 8:
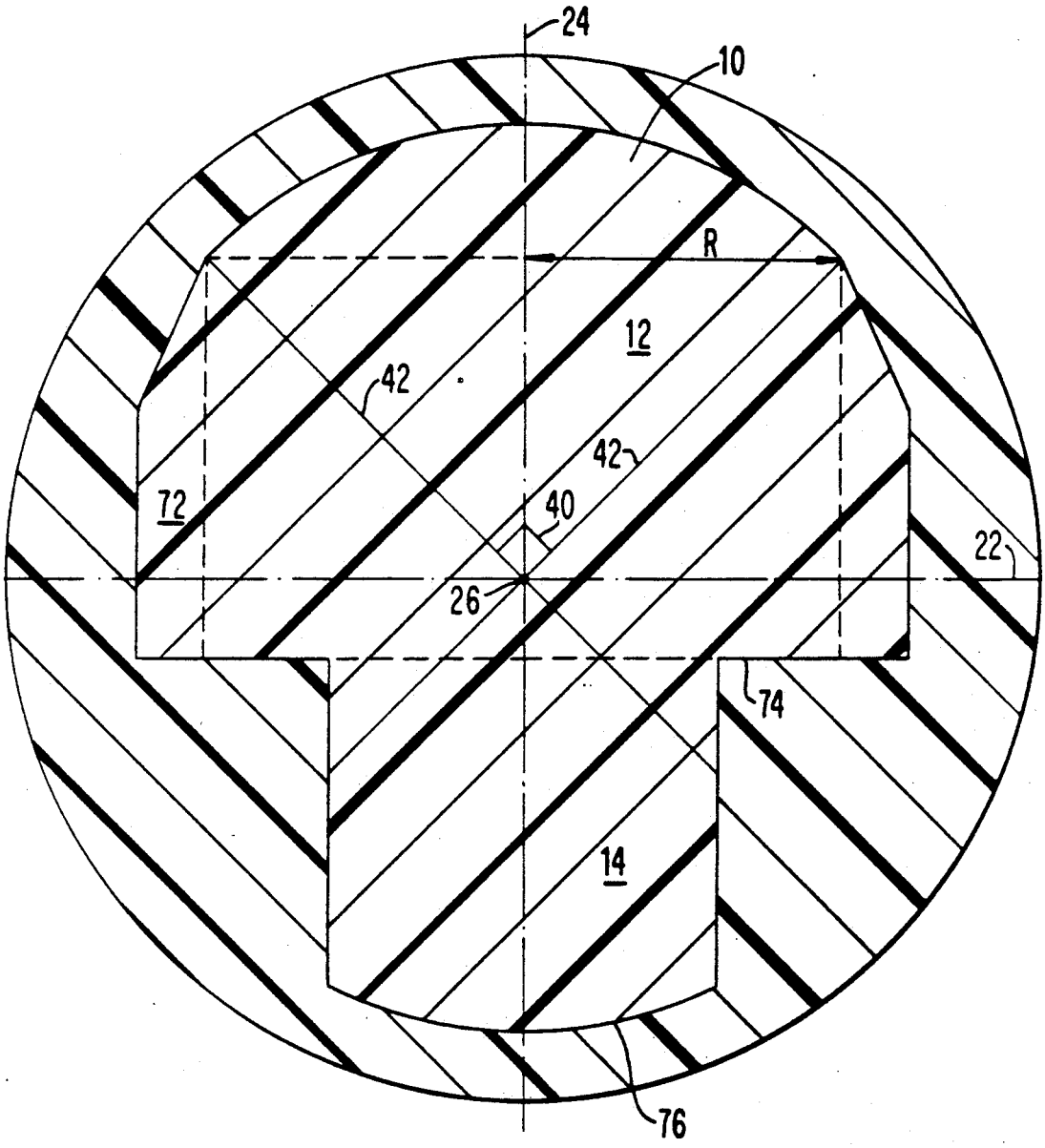

FIG. 8 illustrates yet another embodiment of the invention. In that embodiment body portion 12 bears ring 72 along the entirety of its length. Tip 14 is of cylindrical configuration of a radius less than that of the body, whereby step 70 is developed at the boby-tip intersection. The tip terminates in spherical cap 76.

It is to be appreciated that modification to the invention as described and depicted herein, can be applied without departing from the spirit thereof. Accordingly, the scope or the present invention is to be measured by the appended claims.

We claim:

1. A bowling ball comprising a core weight block of a first density surrounded by a shell of a second density, said core weight block having head, body and tip portions, the head portion being in the form of a spherical segment positioned above the horizontal center line of the ball, the spherical surface of the head being concentric with the shell surface, the body including a generally cylindrical form, and said tip portion and said cylindrical form each having no transverse dimension greater than the transverse dimension of said head portion, said tip portion terminating in a curved surface, and said tip portion and a lower portion of said body portion being located below the horizontal center line of the ball and being further dimensioned such that the total weight of the portion of the weight block below the ball center line is less than the weight of the portion of the weight block above the center line, the longitudinal axis of said weight block passing through the geometric center of the ball.

2. The bowling ball of claim 1 wherein said body portion is chosen from the group consisting of a cylinder and a parallelepiped.

3. The bowling ball of claim 2 wherein said body is a parallelpiped having at least six sides.

4. The bowling ball of claim 1 wherein said tip is of a generally tapered shape.

5. The bowling ball of claim 1 further comprising an annular ring about said body portion.

6. The bowling ball of claim 1, wherein said body is of a length no greater than twice the radius of said head portion.

7. The bowling ball of claim 6, wherein said weight block is positioned such that said head lies above the horizontal centerline of said ball and said tip lies below said centerline, said body extending from said head to a point below said centerline.

8. A bowling ball comprising a core weight block of a first density surrounded by a shell of a second density, said core weight block having head, body and tip portions, the head portion being in the form of a spherical segment positioned above the horizontal center line of the ball, the spherical surface of the head being concentric with the shell surface, the body including a generally cylindrical form, and said tip portion and said cylindrical form each having no transverse dimension greater than the transverse dimension of said head portion, said tip portion terminating in a curved surface, and said tip portion and a lower portion of said body portion being located below the horizontal center line of the ball and being further dimensioned such that the total weight of the portion of the weight block below the ball center line is less than the weight of the portion of the weight block above the center line.

9. The bowling ball of claim 8 wherein said body portion is chosen from the group consisting of a cylinder and a parallelepiped.

10. The bowling ball of claim 9 wherein said body is a parallelepiped having at least six sides.

11. The bowling ball of claim 8 wherein said tip is of a generally tapered shape.

12. The bowling ball of claim 8 further comprising an annular ring about said body portion.

13. The bowling ball of claim 8, wherein said body is of a length no greater than the diameter of said head portion.

14. The bowling ball of claim 13, wherein said weight block is positioned such that said head lies above the horizontal centerline of said ball and said tip lies below said centerline, said body extending from said head to a point below said centerline.

* * * * *